United States Patent [19]

Achelpohl

[11] 3,946,629

[45] Mar. 30, 1976

[54] APPARATUS FOR SEVERING SECTIONS FROM A WEB OF MATERIAL

[75] Inventor: Fritz Achelpohl, Lengerich of Westphalia, Germany

[73] Assignee: Windmoller & Holscher, Lengerich of Westphalia, Germany

[22] Filed: June 23, 1975

[21] Appl. No.: 589,003

[30] Foreign Application Priority Data

July 1, 1974 Germany ..... 2431543

[52] U.S. Cl. ..... 83/304; 83/152; 83/339; 83/345; 83/422

[51] Int. Cl.[2] ..... B26D 1/40

[58] Field of Search ..... 83/304, 339, 345, 338, 83/152, 422

[56] References Cited

UNITED STATES PATENTS

| | | | |
|---|---|---|---|
| 966,408 | 8/1910 | Hollingsworth | 83/338 |
| 3,272,047 | 9/1966 | Ward | 83/338 |
| 3,561,311 | 2/1971 | Nowak et al. | 83/304 X |

*Primary Examiner*—Frank T. Yost
*Attorney, Agent, or Firm*—Fleit & Jacobson

[57] ABSTRACT

Apparatus for severing sections from a web of material advanced by a feed roller comprises helical cutting blades on cylinders interconnected by helical gears. The feed roller can be coupled to and uncoupled from a drive by a dog clutch and the cutting cylinders are positively connected to the drive. Means are provided for axially displacing one of the cutting cylinders when the feed roller is being uncoupled from the drive, whereby to separate the cutting blades, and for returning the cylinder to bring the blades back into cutting relationship when the feed roller is being coupled to the drive.

4 Claims, 2 Drawing Figures

APPARATUS FOR SEVERING SECTIONS FROM A WEB OF MATERIAL

The invention relates to apparatus for severing sections from a web advanced by a feed roller, comprising helical cutting blades disposed transversely to the web on cutting cylinders which are interconnected by helical gears, at least one of the cylinders being mounted for axial displacement.

Apparatus for severing sections from a web of material advanced by a feed roller is, for example, used in bag or sack-making machinery to sever bag sections from a tubular web or to sever cover sheets for the bases of the bags from a corresponding web of cover sheet material. In bag or sack-making machines, the folded bases are often finished off by a cover sheet that is stuck into position and that may be printed so as to identify the contents or origin of the bag, in addition to the printing that may appear on the side walls of the bag. During manufacture, disruptions may occur in the machine if the constant supply of continuously moved bag sections is interrupted or if some bags have to be removed because of faults or blockages. In this event the supply of cover sheets for the bases should also be interrupted because otherwise the presence of a cover sheet for a missing bag will cause even more disruption.

The interruption of the supply of cover sheets is usually effected by uncoupling the feed roller for the web of cover sheet material from its drive after the last desired cover sheet has been severed from the web. In the case of high speed machinery, there arises a disadvantage in that the web of cover sheet material will continue to be advanced even after the feed roller has been uncoupled. This is because of the high momentum of the components of the drive for the feed roller and of the feed roller itself. Consequently, a leading length of the web of cover sheet material still moves to project beyond the line of cut between the cutting cylinders. The cutting cylinders continue to rotate and thus the projecting web portion is unintentionally cut off, constitutes waste and and must be sucked away or otherwise removed. By reason of the missing length from the now leading end of the web, the next cover sheet to be severed from the web during normal operation will be too short and will not adequately cover a hot melt adhesive that has been pre-applied to a bag section to which the cover sheet is to be stuck. The exposed adhesive will give rise to sticking problems during further processing. It will therefore be evident that the continued rotation of the feed roller for the web of cover sheet material after the feed roller is supposed to stop gives rise to considerable problems and these problems are even further aggrevated if the cover sheet material is provided with printed matter.

In a severing apparatus known from German Specification 814,236, one or both cutting cylinders are displaced across a web of paper during the actual cutting step so as to prevent deflection of the web from its proper path. The required axial displacement of the cutting cylinder or cylinders is effected by means of a cam control, the helical gears ensuring that the helical cutting blades are not separated from one another during the cut. However, unintentional or incorrect severing of the web cannot be avoided by the known apparatus when the supply of web material is interrupted.

It is an object of the present invention to provide a severing apparatus which, even during stopping and restarting of the web, ensures that incorrect severing is avoided and that sections of the desired length are severed from the web in the correct phase.

According to the invention, apparatus for severing sections from a web advanced by a feed roller comprises helical cutting blades disposed transversely to the web on cutting cylinders which are interconnected by helical gears, at least one of the cylinders being mounted for axial displacement, wherein the feed roller can be coupled to and uncoupled from a drive by a one-finger dog clutch, the cutting cylinders are positively interconnected to the drive, and means are provided for axially displacing at least said one of the cutting cylinders in the sense of separating the cutting blades when the feed roller is being uncoupled from the drive and for returning the cylinder to bring the blades back into cutting relationship when the feed roller is being coupled to the drive.

The one-finger dog clutch ensures that during coupling the feed roller will advance the web in the correct phase towards the cutting blades that have continued to rotate even during standstill of the feed roller. However, by reason of the axial displacement the cutting blades are made inoperative when the feed roller is uncoupled. Since the cutting cylinders are positively connected to the machine drive and the feed roller, or each feed roller if there are more than one, can be recoupled to the drive in the correct phase, a severing cut will be made in the web at the correct position after there has been an interruption in the web supply to the cutting cylinders. Accordingly, all that is necessary during an interruption in production is to uncouple the feed roller or feed rollers for the web. Braking and subsequent acceleration of the cutting cylinders and the various components required for this can therefore be dispensed with.

German Specification 2,122,071 discloses a severing apparatus for webs in which a stationary cutting blade can be disengaged from an associated blade by pivoting it about its longitudinal axis. The use of stationary cutting blades for severing rapidly fed webs of material is problematic, especially if the webs are of plastics film. The present invention has been particularly developed for severing apparatus for plastics film. Further, disruptions are likely to occur when using stationary blades for severing webs that may be coated with adhesive.

An example of the invention will now be described with reference to the accompanying drawing, wherein.

Figure 1:
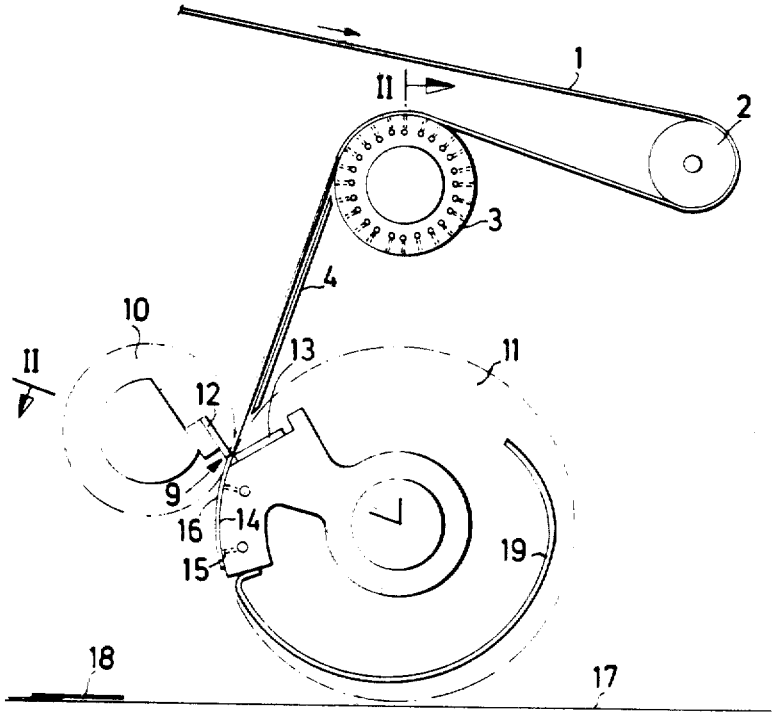
FIG. 1 is a diagrammatic side elevation of the severing apparatus.

A pretreated web 1 of material coated with adhesive is fed to a feed roller 3 over a direction-changing roll 2. The feed roller is in the form of a suction roller, i.e. its periphery is provided with a number of radially extending orifices which communicate with a suction pump (not shown) in such a way that suction is applied only to those orifices that are covered by the web 1. The suction effect of the roller 3 causes the web 1 to be held to the periphery of the roller and carried along by it during rotation. Downstream of the feed roller 3 there is a guide plate 4 for the web 1 advanced by the roller 3.

An imaginary extension of the guide plate 4 intersects the line 9 of cut of two cutting cylinders 10, 11 which are provided with blades 12, 13 extending parallel to the blade shaft. An upstream portion of the periphery of the cutting cylinder 11 as viewed in the direction of its rotation is in the form of a suction face 14 equipped with orifices 15 disposed next to one another in the peripheral direction and behind one another in the axial direction. The orifices 15 communicate with a suction pump (not shown). Sections 16 of material severed from the web 1 along the line 9 of cut are retained by the suction face 14. By means of a rotating guide plate 19, the section 16 that hangs from the guide plate 4 and therefore enters the circle on which the suction face 14 is disposed is held at a spacing corresponding to the radius of the suction face 14. Beneath the cutting cylinder 11 there is a conveyor 17 for feeding bag sections 18 synchronously with the rotation of the cutting cylinder 11, it being intended that the severed sections 16 are to be adhered to the bag sections 18. The bag sections 16 are carried along by the cylinder 11 for about one quarter of its rotation and then applied to the bag sections 18 at the correct position.

Figure 2:
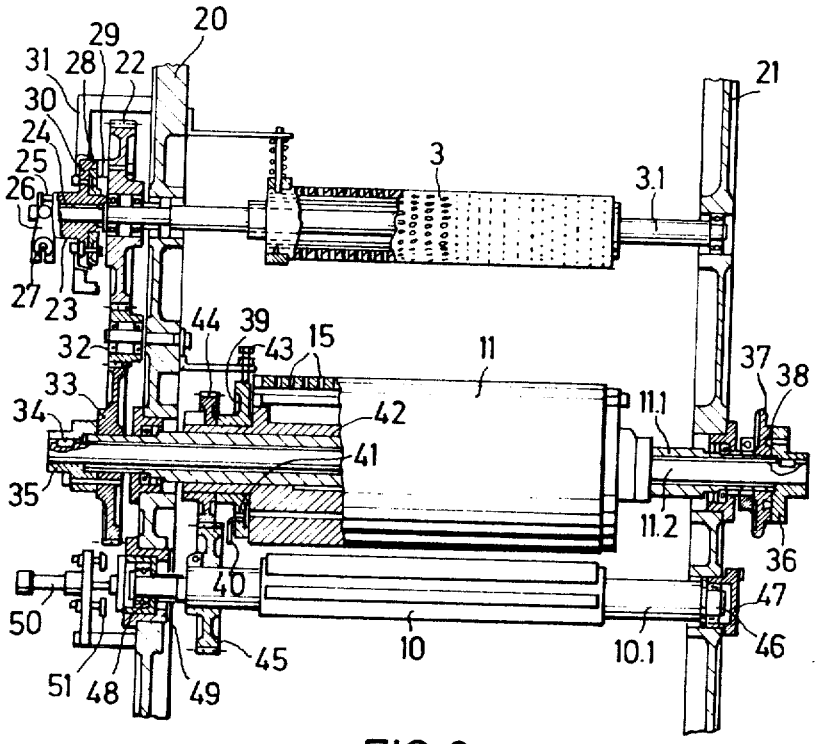
FIG. 2 is a reduced section on the line II—II in FIG. 1.

Referring to the cross-section in FIG. 2, it will be noted that the feed roller 3 and cutting cylinders 10, 11 are rotatably mounted in walls 20, 21 of the frame of the apparatus. A gear 22 is loosely rotatable on the shaft 3.1 of the feed roller 3 and a one-finger dog clutch 23 is longitudinally displaceable on said shaft. By means of a key 24, the dog clutch 23 can transmit torque to the shaft 3.1. The clutch comprises a radial groove 25 in which a lever 26 is engaged, the latter being pivotable about a shaft 27. At one end of the dog clutch 23 there is a finger 28 which can engage an abutment 29 fixed to the gear 22, whereby torque transmitted by the gear 22 is transmitted to the dog clutch 23. The surface of the dog clutch is in the form of a braking cone 30 which, at an appropriate displaced position of the dog clutch 23, engages in conical braking surfaces provided in a bracket 31 of the wall 20. By pivoting the lever 26 into one extreme position, the shaft 3.1 is braked under the action of the braking cone 30 co-operating with the bracket 31 and by pivoting the lever to the other extreme position the shaft is set in rotation by the gear 22 with the aid of the finger 28 and abutment 29.

The gear 22 engages a gear 33 via an intermediate gear 32 or via change gearing for adapting the width of the cover sheet that is to be severed from the web, the gear 33 being seated with a slide fit on the hollow shaft 11.1 of the cutting cylinder 11. The gear 33 is driven by the main drive of the machine. The hollow shaft 11.1 contains a rod 11.2 which is connected at one end to the gear 33 by means of a key 34 and an intermediate member 35. At its other end, the rod 11.2 is provided with a flange 36 which is releasably connected by screws 38 to a hand wheel 37 that is clamped to the hollow shaft 11.1. After releasing the screws 38, the hand wheel 37 can be turned relatively to the flange 36, whereby the phase position of the cutting cylinder 11 can be changed relatively to the drive, for example relatively to the gear 33.

One end of the cutting cylinder 11 is provided with a plate 39 having a suction supply conduit 40. The conduit 40 communicates with the orifices 15 of the cutting cylinder 11 through an annular passage 41. The plate 39 is a slide fit on the hub-like extension 42 of the cutting cylinder 11 and is held against rotation by a bolt 43 on the frame. The annular passage 41 is formed so that the sections 16 are held to the suction face 14 during severing and are passed onto the bag sections 18 after about one quarter of a revolution of the cutting cylinder 11.

A gear 44 connected to the cutting cylinder 11 engages a gear 45 fixed to the cutting cylinder 10. Both gears are helical gears. The gear 45 is wider than the gear 44. The shaft 10.1 of the cutting cylinder 10 is displaceably mounted in the wall 21 of the frame in that the journal of the roller bearing 46 is longer than the width of the roller bearing. It is held in a bushing 47 fixed to the frame. On displacement of the shaft 10.1 in the axial direction, the rollers move over the journal.

A roller bearing 48 is fixed to the other end of the shaft 10.1 and to a bushing 49 that is axially displaceable in the wall 20 by a pressure cylinder 50 carried by the frame. The displacement is limited by abutments 51 and by the base of a hole in the wall 20 that receives the bushing 49.

The blades 12, 13 of the cutting cylinders 10, 11 can be disengaged by actuating the pressure cylinder 50. This is because, by reason of the helical gears 44, 45, longitudinal displacement of the cutting cylinder 10 causes it to be rotated corresponding to the helix angle of the gears and thus the cutting edges of the blades 12, 13 will no longer simultaneously pass through the line 9 of cut.

The control for the pressure cylinder 50 is coupled to the pivotal motion of the lever 26 so that, as the feed roller 3 is uncoupled, the cutting cylinders 10, 11 are brought out of engagement. If the feed roller 3 should continue to rotate in a high speed machine despite the braking by the braking cone 30, the leading end of the web 1 will not be severed because the continuously rotating cutting cylinders 10, 11 are out of engagement. When recoupling the feed roller 3 to the drive, the finger 28 ensures that the feed roller 3 is reconnected in the same phase position relatively to the drive and thus relatively to the cutting cylinders 10, 11 as when it was uncoupled. Upon renewed rotation of the feed roller 3, the blades 12, 13 of the cutting cylinders 10, 11 are brought into engagement again so that the next section 16 is severed from the web 1 in the correct phase position.

I claim:

1. Apparatus for severing sections from a web advanced by a feed roller, comprising cutting blades disposed transversely to the web on cutting cylinders which are interconnected by helical gears, at least one of the cylinders being mounted for axial displacement, means including a one-finger dog clutch to couple and uncouple the feed roller from a drive means, the cutting cylinders being positively connected to the drive, and further means are provided for axially displacing at least said one of the cutting cylinders to separate the cutting blades when the feed roller is being uncoupled from the drive and for returning the cylinder to bring the blades back into cutting relationship when the feed roller is being coupled to the drive.

2. Apparatus according to claim 1, wherein the surface of the dog clutch is in the form of a braking cone engageable in brake surfaces of a bracket secured to a frame of the apparatus.

3. Apparatus according to claim 1, wherein one of the cutting cylinders is adjustable with respect to a drive gear therefor by means of a hand wheel acting through a flange, a rod and an intermediate member.

4. Apparatus according to claim 1, wherein said displacing means comprise a pressure cylinder acting on a bushing and a roller bearing.

* * * * *